US005143559A

United States Patent [19]

Muramatsu et al.

[11] Patent Number: 5,143,559

[45] Date of Patent: Sep. 1, 1992

[54] BORONIZED SLIDING MATERIAL HAVING HIGH STRENGTH AND METHOD FOR PRODUCING THE SAME

[75] Inventors: Shogo Muramatsu; Tomotada Yasuda, both of Aichi, Japan

[73] Assignee: Taiho Kogyo Co., Ltd., Toyota, Japan

[21] Appl. No.: 642,581

[22] Filed: Jan. 17, 1991

[30] Foreign Application Priority Data

Jan. 18, 1990 [JP] Japan ..... 2-7101

[51] Int. Cl.[5] ..... C22C 29/14

[52] U.S. Cl. ..... 148/279; 148/902; 148/320; 148/529

[58] Field of Search ..... 148/14, 279, 902, 320, 148/683, 685, 610, 627

[56] References Cited

PUBLICATIONS

Golubets et al., "Effect of diffusion boronizing on the wear resistance of medium C steel" Fiz Khim, Mekh Mater, 12(4), 88–91, 1991.

Pokhmurskii et al., "Treatment of thick diffusion coatings for increased abrasive wear resistance of maching parts" Zashch Pokrytiya Met., 9, 150–152, 1991.

*Primary Examiner*—Deborah Yee

*Attorney, Agent, or Firm*—Armstrong & Kubovcik

[57] ABSTRACT

A boronized sliding material, which comprises a boronized layer formed on a steel substrate, characterized in that the steel substrate has a sorbitic structure or mixed, sorbitic and pearlite structure.

12 Claims, 5 Drawing Sheets

BORONIZED SLIDING MATERIAL HAVING HIGH STRENGTH AND METHOD FOR PRODUCING THE SAME

BACKGROUND OF THE INVENTION

1. Field of the Invention

The present invention relates to a sliding material having a high strength and a method for producing the same. More particularly, the present invention provides a boronized sliding material having excellent sliding characteristics due to boronizing and also having high strength. In addition, the present invention provides a method for strengthening a boronized material.

2. Description of Related Art

Since boronizing enables extremely hard borides to form, it can be applied to the hardening treatment of various sliding materials. They are, for example, ferrous materials which are subjected to a bending load and compression load by a vane, or the like, of an oil pump or cooler, and, which are brought into contact with an aluminum-alloy. A sliding shaft, a bearing of an engine, and transmission parts are also examples of the above described sliding materials.

Japanese Unexamined Patent Publication No. 63-159685 filed by Taiho Kogyo Co., Ltd, proposes as a vane for a compressor, a ferrous substrate which is boronized to form a boronized layer having a hardness of from Hv 1200 to 1850. Medium carbon-steel for constructional use (S45C and S55C under the JIS designation), bearing steels (SUJ), alloyed tool-steels (SKS), and alloyed die-steels for hot-forming (SKD) are mentioned in the description as the ferrous materials. S45C is described in the example of the above Japanese publication.

In boronizing, a substrate is heated to a temperature of from 750° to 950° C. in a powder of boron carbide or like, followed by slow cooling. This slow cooling is conventionally used so as to avoid the disadvantages brought about by rapid cooling. If the substrate is rapidly cooled after the boronizing, then thermal strain or transformation strain will become so great that not only dimension accuracy of the substrate becomes impaired but also strain of the substrate and strain of the boronized layer are combined to cause cracking of the boronized layer.

Boronized medium carbon-steels, such as S45C, exhibit an annealed structure which consists of ferrite and pearlite. A substrate consisting of the medium carbon-steel is therefore lacking in strength because the optimum strength is obtained by quenching and tempering to form the tempered structure.

The present inventors considered subjecting the boronized and then slow-cooled S45C to quenching and tempering which is a standard heat-treatment. The strength of the substrate can be enhanced, but the dimensions of the substrate are changed by the heat-treatment. This in turn causes a problem in that the extremely hard boronized layer must be machined to restore the proper dimensions. In addition, unless extremely careful heat-treatment is carried out in the quenching, the strain on the boronized layer and the quenching strain are combined to result in quenching crack and surface crack. It is therefore difficult to apply the ordinary quenching and tempering treatment to a boronized sliding material.

If the boronized sliding material has poor strength, the design of the sliding parts is limited causing production of light-weight parts to become difficult, and, the scope of further application of boronized material to machines and parts is thus limited.

SUMMARY OF THE INVENTION

It is therefore a general object of the present invention to provide a boronized sliding material, in which excellent sliding characteristics and high strength are combined.

It is a specific object of the present invention to suppress strain and cracking of a boronized sliding material.

It is another specific object of the present invention to enhance dimension accuracy of a boronized sliding material.

It is a further specific object of the present invention to enhance the bending strength and deflecting strength of a boronized sliding material.

It is another general object of the present invention to provide a strengthening method for a boronized material, which can strengthen the boronized material without impairing its dimension accuracy.

The present inventors did research on the relationship between the cooling speed of a substrate which is allowable after the boronizing, the strength required for a sliding material, strain generated during the cooling, and metallographic structure. The present inventors then discovered the following.

(1) The speed of post-cooling after boronizing can be increased to faster than the conventional level, that is, the level causing ferrite and pearlite to be formed without causing considerable strain.

(2) The speed of post-cooling after boronizing can be increased to such a level a sorbite structure is formed in a substrate. It is therefore possible to utilize the higher strength of the sorbitic structure than that of the mixed ferrite-pearlite structure, thereby providing a boronized material having a high strength.

There is therefore provided a boronized sliding material having a boronized surface, wherein the non-boronized body of a substrate consists of steel having a sorbitic structure or a structure essentially consisting of sorbite and pearlite, under the boronized surface thereof.

Phases other than the sorbite and pearlite, i.e., ferrite, and bainite, preferably constitute less than 50% of the structure of the substrate, because of the following reasons. 50% or more of the ferrite causes considerable reduction in hardness and strength. The substrate having 50% or more of bainite or martensite is undesirable in the light of strain. The substrate having 50% or more of pearlite is slightly less hard than the substrate consisting of sorbite structure. The strength of the former substrate is unsatisfactory for the sliding members, whose strength requirement is moderate.

The substrate having 50% or more of the sorbite allows for the production of compatible strength and low-strain. The structure of the substrate according to the present invention may contain one or more phases other than sorbite. Ferrite is the most undesirable in the light of strength. The ferrite is therefore preferably limited to 30% or less. The pearlite is the most desirable other phase in the light of balanced high-strength and low-strain. The structure of the substrate according to the present invention therefore consists only of sorbite or essentially consists of both sorbite and pearlite. The sorbite is preferably from 10 to 100%, more preferably from 50 to 100%, while the pearlite is from 0 to 90%.

In Table 1 are given the results of the inventors' research on the relationship between the carbon content of the substrate, the post-cooling speed, and structure and hardness of the substrate.

TABLE 1

| Carbon Content (%) | Cooling Speed (°C./min) | Structure | Hardness (Hv) |
|---|---|---|---|
| 0.45 | 0.5-1 | Ferrite + Pearlite | 150-200 |
| 0.82 | 0.5-1.5 | Pearlite | 200-250 |
| 0.82 | 3.0- | Pearlite + Sorbite | 260-350 |

The cooling speed given in Table 1 is an average value of cooling from the austenitizing temperature to the Ar' transformation point. As is apparent from the above table, high hardness and strengthening are attained by limiting the carbon content to the hyper-eutectoid value and the post-cooling speed to 3.0° C./min or more.

The carbon content of 0.45% and the cooling speed of 0.5°-1° C./min corresponds to the prior art described hereinabove. The ferritic and pearlitic structure is an annealed structure having a low strength. The present inventors discovered that no crack generation occurred at the cooling speed of 3.0° C./min, or even at 1250° C./min attained by blasting cold air, provided that the structure is mainly composed of sorbite.

When the 0.82% C steel has a hardness of Hv (0.05 kg load) 350, its structure is 100% sorbite. When the 0.82% C steel has a hardness of Hv 260, its structure is 50% sorbite and 50% pearlite. In the mixed, sorbitic and pearlitic structure, the hardness of sorbite is Hv 320-350, while the hardness of pearlite is Hv 290-310. The hardness of the mixed sorbitic and pearlitic structure is somewhere between these values.

BRIEF DESCRIPTION OF DRAWINGS

In FIG. 1 are shown the results obtained by research, in which a 0.82% C steel is subjected to cooling at various cooling speeds, and then the structure and hardness are investigated. As is apparent from this drawing, it is possible to obtain a substrate having hardness ranging from Hv 250 to 320 and a structure of pearlite plus sorbite.

Figure 2:
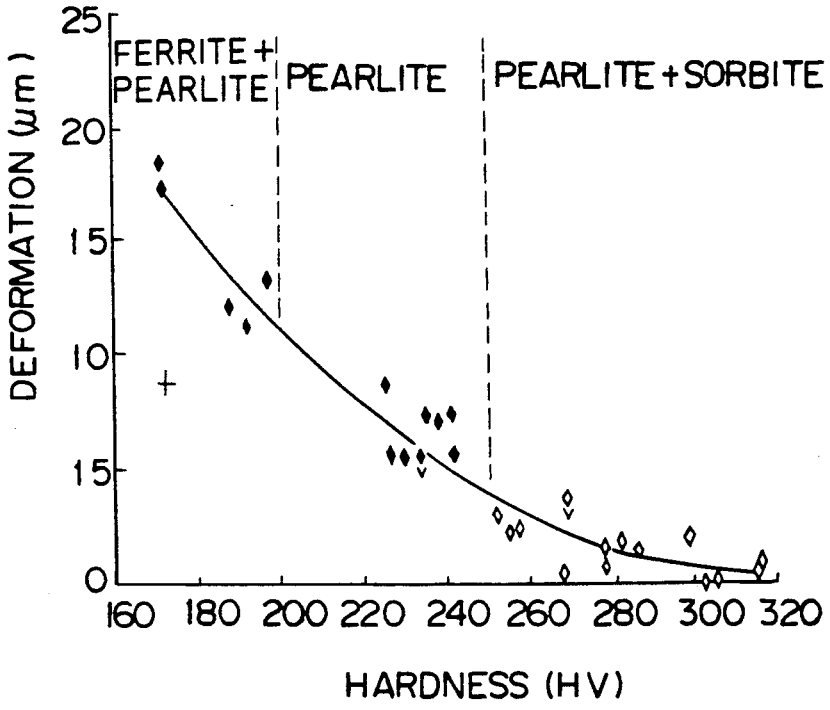
FIG. 2 is a graph illustrating the relationship between the hardness, structure and defecting deformation amount of various carbon steels.

Various substrates obtained in the research as described above were machined to form specimens 2×14×35 mm in size. 2 tons of weight were applied to the center of the specimens so as to deflect them by the load. The results are shown in FIG. 2. As is apparent from this drawing, the amount of deformation the specimens with a mixed sorbitic and pearlitic structure is as low as a half of that of specimens with a single ferrite phase.

The above described structure is obtained by adjusting the post-cooling speed after boronizing at a temperature of usually 800°-850° C. The cooling method may be furnace cooling provided that the cooling speed is adjusted, by means of, for example, de-energizing a power source to a level higher than that in an ordinary furnace cooling. The cooling method may be air-cooling, natural cooling, or forced cooling by blasting cold air. The carbon content of a substrate may be of any value, provided that the above structure is obtained. It is however practical for the carbon content to be 0.4% or more, preferably from 0.6 to 0.9% in the light of the above mentioned cooling methods which are appropriate after the boronizing. A proeutectoid cementite is formed in the post-cooled substrate when the carbon content is in a hyper-eutectoid range. Since the amount of the hyper-eutectoid cementite is small, its influence upon the strength is not appreciable. On the other hand, when the carbon content is in the hypo-eutectoid range and the boronizing temperature is low, ferrite is formed. It is advisable then to enhance the post-cooling speed so that the amount of ferrite is suppressed to a level of 30% or less.

Figure 1:
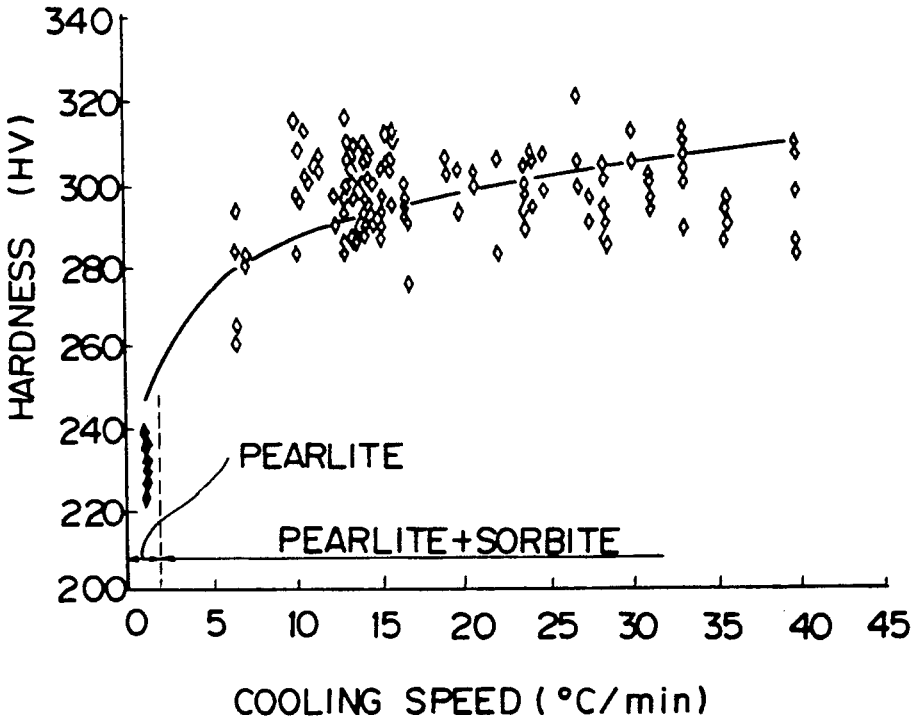
FIG. 1 is a graph illustrating the relationship between the hardness and the cooling speed.

When it is necessary to obtain strength higher than the level as is illustrated in FIGS. 1 and 2, it is possible to add an alloying element(s), such as Ni, Cr, Mo, Mn or the like, into the substrate material. Any one of these elements is dissolved in the ferrite. The solute Ni or the like strengthens the ferrite and enhances its toughness, thereby providing a substrate which is highly resistant against buckling deformation and bending. Regarding particular function of the alloying elements, Ni and Mn suppress the formation of pearlite and promote the formation of sorbite. This is a hardening function of Ni and Mn. However, when their content exceeds 5%, the austenite is so stabilized that bainite is formed to an amount up to 30% or more, thereby disadvantageously resulting in a drastic generation of strain. Mo and Cr in an amount of 5% or less retard the pearlite transformation, thereby increasing the proportion of sorbite and hence contributing to the hardening. In addition, the generation of strain due to formation of special carbides in a large amount is not considerable.

It is possible by means of adding an alloying element(s), such as Ni, Cr, Mo or the like, to obtain a high strength at a carbon content lower than that of the carbon steels, or vice versa to obtain a strength higher than carbon steels at the identical carbon content. Low carbon-steels alloyed or non-alloyed generally provide advantages such that working as-rolled or annealed steel is easy. The substrate can therefore be easily machined to a final shape before the boronizing. The carbon content of the alloyed steel is therefore preferably adjusted to a low level. In addition, the special carbides, which are formed by adjusting the carbon content of the alloyed steels to a high level, advantageously strengthen a substrate due to their high hardness. However, an appropriate method for controlling the morphology of the special carbides is tempering at a high temperature. This tempering is not carried out, as a rule, in the present invention, because the desired structure is obtained fundamentally by adjusting the post-cooling speed. It can therefore be said that the alloying elements added to high-carbon steels are not fully utilized for strengthening. The carbon content of the alloyed steel is therefore preferably low, specifically, in a hyper-eutectoid range and a virtually eutectoid point. A preferable carbon content is from 0.2 to 0.8%. The alloyed substrate is used as a high strength sliding member, which is in sliding contact with an aluminum alloy which contains a high content of Si, has thus a high hardness, and a tendancy to greatly wear the sliding member.

It is the most advantageous to obtain the desired structure by post-cooling. However, heat-treatment may be carried out after the post-cooling. Such heat-treatment is, for example, stress-relief annealing. In addition, when the bainite formed is too great, heat-treatment at a temperature lower than the transformation temperature may be carried out so as to diffuse carbon and to produce carbide. Furthermore, in the case where post-cooling fails due to, for example, furnace trouble a substrate may be immediately heated again to an austenitizing temperature before accumulation of strain in the substrate. The substrate is then cooled in a desired manner. The speed at which the temperature is elevated to the austenitizing temperature must be slow, because rapid heating involves the danger of cracks being formed in the boronized layer due to stress, which is accumulated in an interface between the boride layer and the substrate and is increased by the rapid heating.

The boronizing may be carried out by a liquid method, in which borax ($Na_2B_4O_7$) with 20–40% by weight of additives, i.e., silicon carbide or boron carbide, is heated to a predetermined temperature to form a molten bath, in which a substrate is immersed for a few hours. The boronizing method may be an electrolytic method, in which borax, a mixture of borax and silicon, or a mixture of borax and sodium chloride, is melted to form a molten bath, in which a substrate is immersed as a cathode and is subjected to electrolysis for a few hours. The boronizing method may be a solid method, in which a substrate is filled in with boron carbide or carbon with additives consisting of silicon carbide, potassium tetra-boride or the like. The solid method is preferred because it is possible by the solid method to obtain a thick boronized layer as thick as 200 μm more easily than by the other methods.

Figure 3:
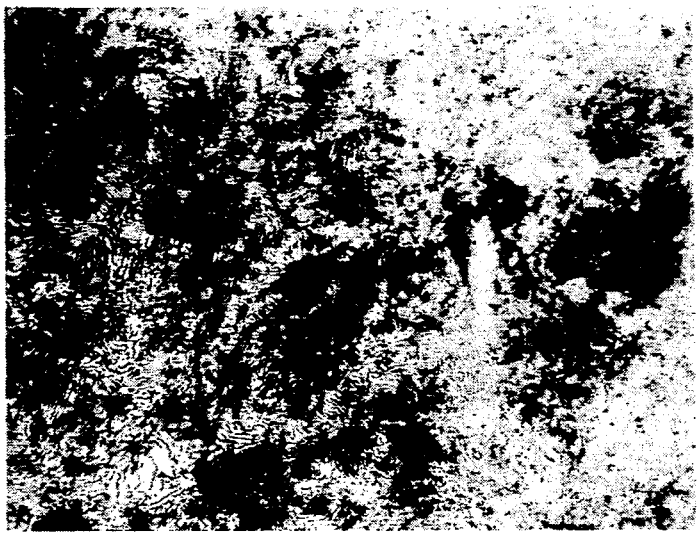
FIG. 3 is a photograph (magnification −400) showing a metal structure of 0.82% C steel cooled at 0.8° C./min.
Figure 4:
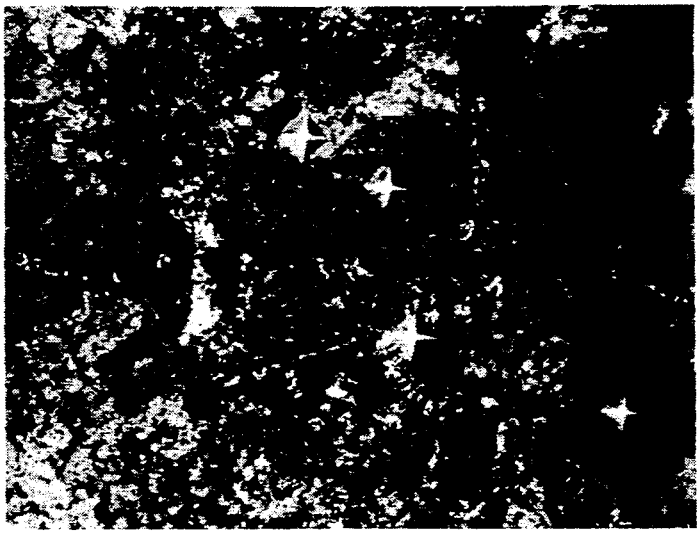
FIG. 4 is a photograph (magnification −400) showing a metal structure of 0.82% C steel cooled at 15° C./min.
Figure 5:
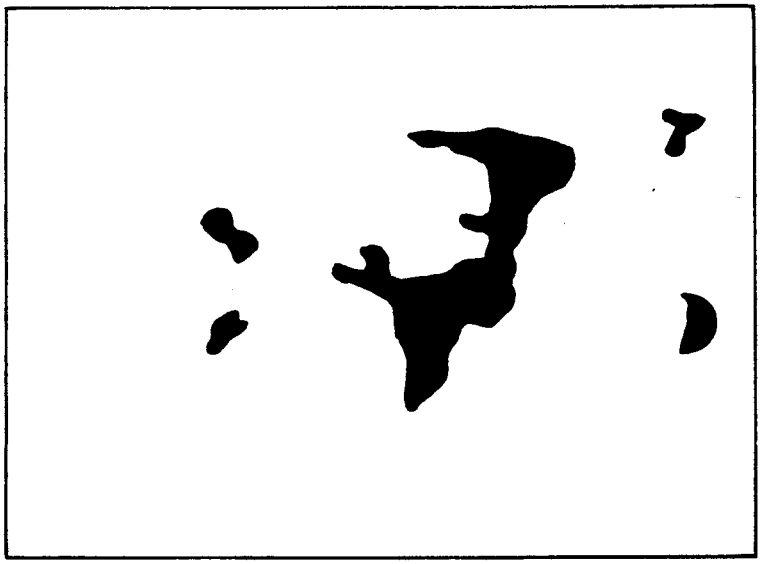
FIG. 5 is a drawing subjected to an image analysis of FIG. 4, in which the pearlite is totally blackened.

The present invention is further described with reference to FIGS. 3 through 5.

Figure 6:
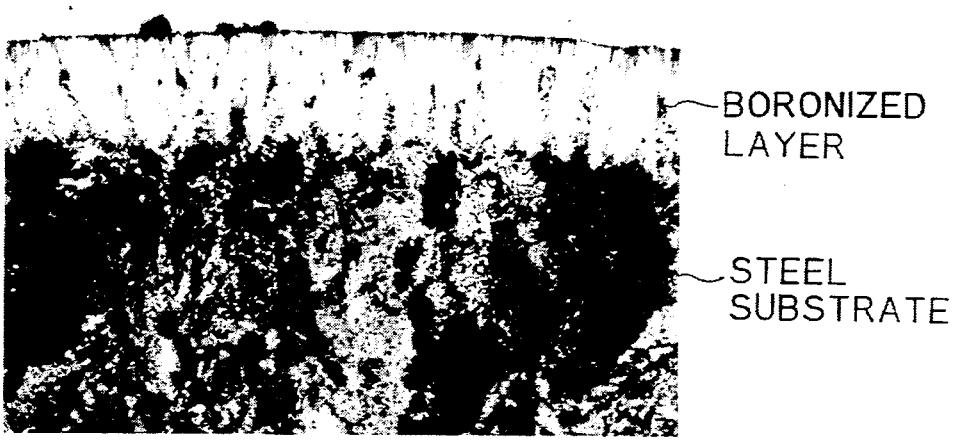
FIG. 6 is a photograph showing a metal structure of a boronized sliding material according to the present invention.

The boronized layer and structure of the substrate are shown in FIG. 6. The substrate's structure mainly consists of sorbite, the balance being pearlite.

EXAMPLE 1

Carbon steel with a carbon content of 0.82% was boronized at 830° C. by a solid method, and a 70 μm thick boronized layer was formed on the substrate. The post-cooling after the boronizing was carried out by furnace cooling (cooling speed—0.8° C./min), and cooling in still air (cooling speed—15° C./min). The furnace cooled, 100% pearlite structure is shown in FIG. 3, and the air-cooled, pearlite plus sorbite structure is shown in FIG. 4. The pearlitic parts shown in FIG. 4 were black-colored in FIG. 5, which was subjected to an image analysis. The percentage of area pearlite was 8.0%.

The hardness was as follows.

Pearlite (FIG. 3)=Hv 246

Pearlite+sorbite (FIG. 4)=Hv 278

EXAMPLE 2

An alloyed steel containing 0.5% of C, 0.2% of Mo, 2.0% of Ni, and 1.0% of Cr was subjected to boronizing by a solid method, followed by cooling at a speed of 15° C./min. A 5 μm thick boronized layer was formed. The hardness of the substrate was Hv 400–600. The structure of the substrate was 60% of sorbite, 30% of bainite, and 10% of pearlite.

We claim:

1. A boronized sliding material, which consists essentially of, a steel substrate comprising a non-boronized sorbitic structure; and a boronized layer on said sorbitic steel substrate.

2. A boronized sliding material, which comprises a non-boronized steel substrate consisting essentially of sorbite and pearlite structure; and a boronized layer on said steel substrate.

3. A boronized sliding material according to claim 2, wherein said structure of the substrate consists of from 10 to less than 100% of sorbite, and not more than 90% of pearlite.

4. A boronized sliding material according to claim 2 or 3, wherein said structure of the substrate consists of pearlite and sorbite, as well as at least one phase selected from the group consisting of 30% or less of ferrite and bainite.

5. A boronized sliding material according to claim 1, 2 or 3, wherein the steel substrate consists of carbon steel having a carbon content of not less than 0.4%.

6. A boronized sliding material according to claim 5, the carbon content is from 0.6 to 0.9%.

7. A boronized sliding material according to claim 1, 2 or 3, wherein the steel substrate consists of alloyed steel containing at least one element selected from the group consisting of Ni, Cr, Mo, and Mn.

8. A boronized sliding material according to claim 7, wherein the content of said alloying element is 5% or less, each.

9. A boronized sliding material according to claim 8, wherein the content in carbon of the substrate is from 0.2 to 0.8%.

10. A method for producing a boronized sliding material, comprising the steps of:

boronizing a steel substrate; and subsequently cooling said boronized steel substrate at a speed sufficient to form a structure of at least 50% sorbite in the non-boronized body of the substrate after cooling.

11. A material as claimed in claim 1 wherein said substrate contains at least 50% by weight sorbite, and less than 50% by weight of at least one of ferrite, bainite, and martensite.

12. The process as claimed in claim 10 wherein said cooling is accomplished at a rate of at least about 3° C. per minute.

* * * * *